US007409747B2

(12) United States Patent
Chen

(10) Patent No.: US 7,409,747 B2
(45) Date of Patent: Aug. 12, 2008

(54) PLIABLE HANDLE

(76) Inventor: Shiow-Hui Chen, P.O. Box 166-13, Taipei (TW) 115

( * ) Notice: Subject to any disclaimer, the term of this patent is extended or adjusted under 35 U.S.C. 154(b) by 672 days.

(21) Appl. No.: 11/054,135

(22) Filed: Feb. 10, 2005

(65) Prior Publication Data

US 2006/0174450 A1 Aug. 10, 2006

(51) Int. Cl.
*A45C 7/00* (2006.01)
*E05B 1/00* (2006.01)

(52) U.S. Cl. ..... 16/430; 16/431; 16/436; 16/421; 16/DIG. 12; 81/489; 81/177.1; 135/25.4

(58) Field of Classification Search ..... 16/430, 16/431, 435, 421, DIG. 12, DIG. 18, DIG. 19; 15/143.1, 144.1, 145, 443; 81/177.1, 177.6, 81/489; 30/322, 323, 340; 156/212, 218; 135/24, 25, 25.41, 25.4; 473/300–303; D8/5, D8/6, 10, 12

See application file for complete search history.

(56) References Cited

U.S. PATENT DOCUMENTS

| | | | | |
|---|---|---|---|---|
| 6,959,469 | B2 * | 11/2005 | Blauer et al. | 16/431 |
| 6,968,599 | B2 * | 11/2005 | Blauer et al. | 16/431 |
| 7,234,205 | B2 * | 6/2007 | Blauer et al. | 16/431 |
| 2003/0051316 | A1 * | 3/2003 | Willat | 16/430 |
| 2006/0124158 | A1 * | 6/2006 | Lin et al. | 135/24 |

* cited by examiner

*Primary Examiner*—Chuck Y. Mah

(57) ABSTRACT

The present invention is aimed to provide a pliable handle, which is cost-effective, speedily assemble, to improve the stability of the central pole and to prevent the gel from leaking out. It is characteristic of a plastic cover placed over a central pole partly defined a gel containing portion for filling gel. Both of the plastic cover and the central pole have stopper flanges or annular lips at their ends to seal the gel portion. Only a set of injection through bores formed through the proximal flange and lip to fit such as a needle-like injector of syringe-like barrel to inject a gel to fill the gel-containing portion. After injection, a projected stopper spindle further presses and seals the set of injection through bores. Said central pole is passed through a proximal cap then secures a distal cap to shape a stable pliable handle.

5 Claims, 4 Drawing Sheets

PLIABLE HANDLE

FIELD OF THE INVENTION

The present invention is related to a pliable handle, particularly to a soft pliable handle maintained temporary transformation shape and delayed to restore original configuration after releasing a grab pressure.

STATE OF THE PRIOR ART

A memory effect pliable handle is disclosed by pending applications in USPTO such as numbered US20040205938A1, which was applied on Oct. 23, 2003, is a continuation in part application of the prior pending application numbered US20040205937A1 applied on Apr. 17, 2003. Both cases have been published on Oct. 21, 2004. The US20040205937A1 teaches a core member 150, an outer sheath 120 is disposed about core member 120, a gel-containing portion 115 is defined between the core member and outer sheath, an injected gel travels through a gel injection through bore 116 fills said gel-containing portion 115. And the US20040205938A1 mentions an outer sheath 120 is disposed about a core member 110 to define a gel-containing portion 815 with the annular flanges 813, 814 at its ends, an injected gel travels through the gel injection through bores 816a, 816b formed through the annular flanges. The plugs 125, 126 are used to seal the injection bores. Thus a pliable handle is fabricated. While an exterior force exerts pressure on the pliable handle, causes load movement of gel to promote a local deformation of the handle. After a grip pressure is released, the deformed pliable handle is remained for a while until movement of gel is returned to the original shape. It has so-called memory effect pliable handle.

BACKGROUND OF THE INVENTION

Refer to FIG. 7 of said US20040205937, the central pole 150 is screwed into the core member 110, the threaded core member 110 is designed to secure the proximal end cap 130 to the outer sheath 120. Or refer to FIG. 20 of said US20040205938, the central pole 150 is screwed into the proximal end cap 1930, both the distal end cap 1940 and the proximal end cap 1930 are secured to the core member 1920 simultaneously, the distal end cap 1970 is secured to the distal sealer 1940 by means of screwing, thus keeps the gel from leaking out of the gel-containing portion. Such US20040205937A1 describes, as the threaded end 151 of the central pole 150 is designed for passing through proximal end cap 130 then secures the threaded bore 117, we can see the available Max screwing limit is in a reduced type by a decreased screw-in. However, while enduring an exterior force exerts pressure, the central pole 150 is easily being lost proper contact from the screwed portion. Sealed gel-containing portion of the outer sheath 120, 1950 is easily being leaked out the movement gel due to the threaded end is likely shown a decreased screw-on.

The prior art US20040205937A1 teaches that a distal end cap 140 is secured to the core member 110 by means of screwing. But the FIG. 20 of the prior art US2004205938A1 indicates that the proximal sealer 1930 is secured to the distal sealer 1940 by means of numerals 1933, 1941 indicated as screw and bore for screwing. The screwing portion is easily being lost proper contact due to long-term operation. Once a distal end cap 140 or 1970 is easily to release the capped tubing pressure leads to the containing movement of gel leaking out.

The prior art US20040205937A1 also teaches a nozzle is passed through the gel injection through bores 816a, 816b which are formed through the core member and outer sheath. After gel injection, the plugs are used to seal the gel injection through bore. They may be fabricated in a series of repeated and trivialized procedure, to invest the equipments or the labor cost of the production line is expensive than anticipated. production line is expensive than anticipated.

SUMMARY OF THE INVENTION

Point against the aforesaid defects, the present invention is to provide a technique solution as claim 1 claimed: a pliable handle 10 comprises: a handle 1, which is composed of a plastic cover 11 with stopper flanges 110 at both ends, an open-end core 12 has annular lips 121 at both ends; said plastic cover 11 is disposed about said open end core 12 to define a gel-containing portion between an inner wall of plastic cover 110 and an outer surface of the open end core 12; one gel-injection through bore 112 is formed through a proximal flange 110 of the plastic cover 11, the other gel injection through bore 123 is formed through a proximal lip 121 of the open-end core; one gel injection through bore 112 is aligned with the other gel injection through bore 123; refer to FIG. 3 a gel 5 is injected through one gel injection through bore 112 and the other 123 to fill said gel-containing portion, the open-end core 12 is surrounded by the gel 5; a tough hardening proximal cap 2 fits onto the handle 1, said proximal cap 2 has a central bore 22 at a center, a proximal board 20 with an inverse barb-like projection 21 projected downward, a diameter of the projection 21 is smaller than a diameter of the proximal cap 2, a peripheral of the proximal board 20 has a stopper spindle 23 projected downward which is spaced from said projection 21, said projection 21 fits into a proximal trough 122 of the open-end core 12, said stopper spindle 23 is used to seal one gel-injection bore 112 and the other 123; a tough hardening distal cap 3 fits onto a distal end of the handle 1, the distal cap 3 has a distal board 30 with an inverse barb-like projection 31 projected upward and a bore 32 formed at a center, a diameter of the projection 31 is smaller than a diameter of the distal board 30, the projection 31 fits into a distal trough 122 of the core 12; after assembly of aforesaid components, a central pole 4 is passed through the proximal end cap 2 and the open-end core 12 of the handle 1 then secures to the distal cap 3.

ADVANTAGES OF EMBODIMENTS OF THE INVENTION

The merits can be achieved by means of the design of the present invention as following.

Pliable handle as the claim 1 claimed, said central pole 4 is passed through the proximal cap 2 and handle 1 to secure the distal cap 3. In other words, the central pole 4 secures the handle 1, proximal cap 2 and distal cap 3 simultaneously, but not combined only one or two of them to form the pliable handle 10. So the pliable handle 10 is placed over the distal end of the central pole 4 completely. That is, not only the central pole 4 secures the pliable handle 10, but also the pliable handle could absorb the impact as the central pole 4 endured the pressure exerted by an exterior force. The present invention thus has combined central pole 4 to form a pliable handle 10 keeps it from a partial attachment that leads to breakage or stirring movements easily.

The distal end of said central pole 4 secures the distal cap 3 by means of screwing or riveting. The projection 31 of the distal cap 3 projects upward and fits into the open end core 12.

The projection 21 of the proximal cap 2 projects downward and fits into the open end core 12. The proximal cap 2, distal cap 3, central pole 4 and the open end core 12 are combined to form a pliable handle 10 and to seal the proximal and distal bores 111 of the plastic cover 11. They are easy to assemble or disassemble as desired.

The proximal board 20 of said proximal cap 2 projects downward a stopper spindle 23, as the proximal cap 2 presses on the handle 1, the projected spindle 23 is used to seal one gel-injection through bores 112 of the plastic cover 11 and the other gel injection through bore 123 of the open end core 12. Particularly as the stopper spindle 23 is passed through one gel injection through bore 112 then fits into the other gel-injection through bore 123 to achieve a preferred sealing effect so as to keep the movement of gel from leaking out of the gel-containing portion.

DETAILED DESCRIPTION OF THE PREFERRED EMBODIMENTS

The description is described according to the appended drawings hereinafter.

Figure 1:
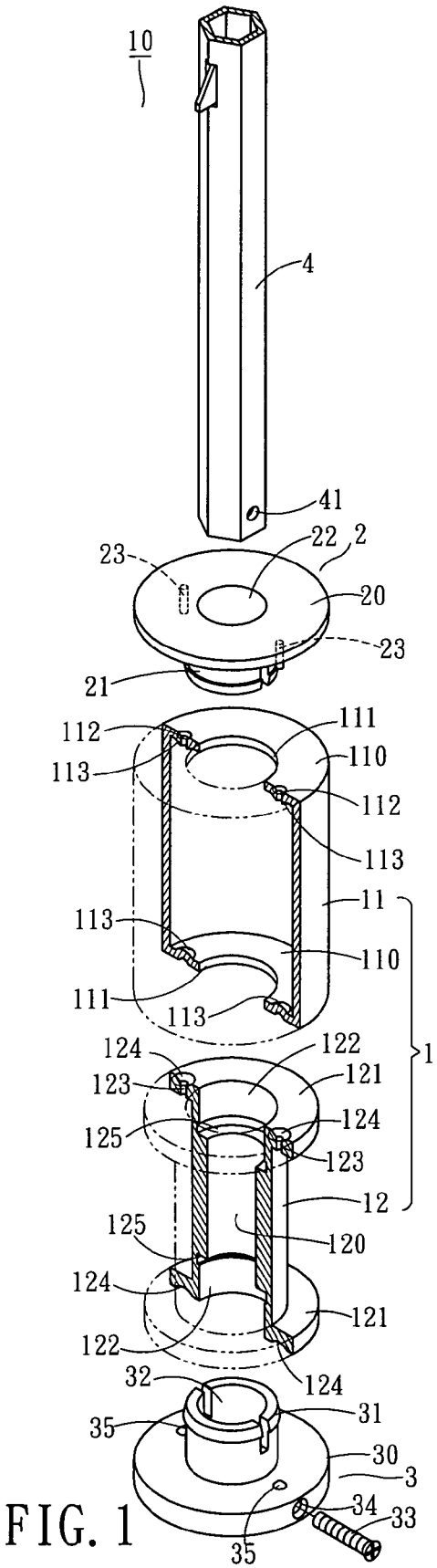
FIG. 1 is an exploded perspective view of the present invention.
Figure 2:
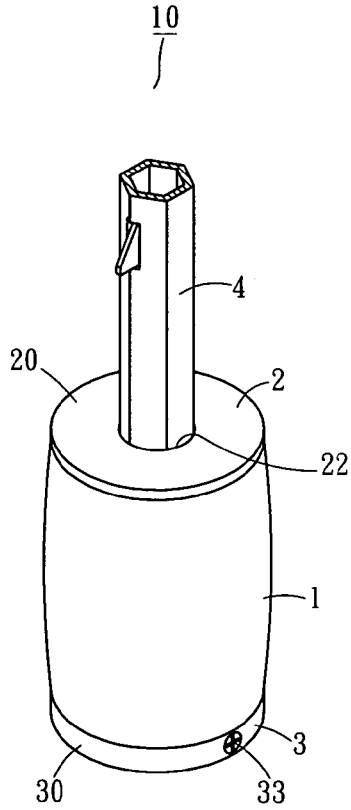
FIG. 2 is an assembly perspective view of the present invention.
Figure 3:
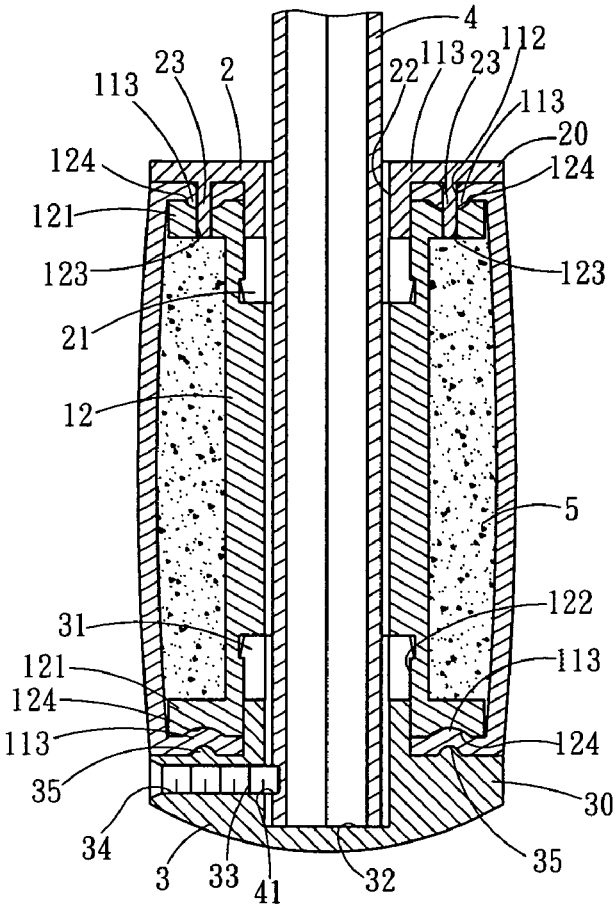
FIG. 3 is a cross section view of the pliable handle of the present invention.

Refer to FIG. 1 is illustrated an exploded perspective view of the present invention. A pliable handle 10 includes a handle 1, a plastic cover 11 is placed over an open end core 12. The plastic cover 11 has a proximal and a distal stopper flanges extended inward at both ends. The open-end core 12 has a proximal and a distal annular lips 121 outreached laterally at both ends. Thus a gel-containing portion is defined between an inner wall of the plastic cover 11 and an outer surface of the open-end core 12. An injection through bore 112 formed through the proximal flange 110 of the plastic cover 11 is aligned with an injection through bore 123 formed through the proximal annular lip 121 of the open end core 12. Refer to FIG. 3, is illustrated a gel 5 injected through one injection through bore 112 and the other 123 to fill the gel-containing portion. The open-end core is surrounded by the gel 5. A tough hardening proximal cap 2 fits onto a proximal end of the handle 1, said proximal cap 2 has a through bore 22 at a center, a proximal board 20 has an inverse barb-like projection 21 axially projected downward from the proximal board 20, a stopper spindle 23 projected downward from said proximal board 20, said spindle 23 is paralleled and spaced from the projection 21, a diameter of the projection is smaller than a diameter of the proximal board 20, said projection 21 fits into a proximal trough 122 of the open end core 12. The stopper spindle 23 is used to seal one injection through bore 112 and the other 123 of the handle 1. A tough hardening distal cap 3 secures a distal end of the handle 1 by screwing with a bore 32 formed at a center of the distal cap 3. An inverse barb-like projection 31 projected upward from the distal board 30, a diameter of the projection 31 is smaller than a diameter of the distal board 30. Said projection 31 fits into a distal trough 122 of the open end core 12. After assembly, a central pole 4 is passed through the proximal cap 2, the open-end core 12 of the handle 1 then secures to the distal cap 3. Refer to FIG. 2, an assembly view of the pliable handle of the present invention is shown. Refer to FIG. 3, a cross section view of the pliable handle is shown.

Said plastic cover 11 is a soft, extensible hollowed sleeve with proximal, distal stopper flanges 110 at both ends. The stopper flanges 110 extended laterally inward to a center of the plastic cover 11 and spread over the annular lips 121 which is outstretched laterally from both ends of the open-end core 12. A gel-containing portion is defined between an inner wall of the plastic cover 11 and an outer surface of the open-end core 12. The other injection through bore 123 formed through the proximal annular lip 121 is aligned with one injection through bore 112 formed through the proximal flange of the plastic cover 11. A needle-like injector of a syringe-like barrel (not shown) is passed through the aligned injection bores 112, 123, then propels the gel 5 (such as silicone, mixed gel or other lotion, paste) injected through to fill said gel-containing portion as the FIG. 3 is shown.

Bores 111 are formed through centers of the proximal and distal stopper flanges 110 of said plastic cover 11 respectively, which are corresponding to a proximal and a distal hollow troughs 122 formed on both ends of the open-end core 12. The open-end core 12 is made of tough hardening plastic. A central bore 120 of the open-end core 12 is in communication with the proximal and the distal hollow troughs 122 at both ends of the open-end core 12. A diameter of the hollow troughs 122 is larger than a diameter of the central bore 120 and a diameter of the central pole 4. An aperture of the central bore 120 is shaped to conform to a circumference of the central pole 4, or a contour and size of the aperture is identical to the circumference of the central pole 4. The central pole 4 is passed through the open-end core 12 to avoid from friction and stirring movements due to the aperture of the central bore 120 is a little larger than and conformed to the circumference of the central pole 4. Said proximal and distal hollow troughs 122 are mainly adapted to fit the projections 21, 31. Owing to the central through bore 22 of the proximal cap 2 and the central bore 32 of the distal cap 3 have almost the same diameter as the central pole 4 has, or the contour and size of said bores 22, 32 are identical to the circumference of the central pole 4, the central pole 4 is passed through the central through bore 22 of the proximal cap 2 then fits into the central bore 32 of the distal cap 3 to avoid from stirring movements.

Furthermore, said central pole 4 secures the distal cap 3 by means of screwing, which can be understood from the FIGS. 1 and 3. A distal end of the central pole 4 first fits into the central bore 32 of the distal cap 3, then passes a screw 33 through a lateral bore 34 of the distal board 30, finally secures the central pole 4 to the pliable handle 10 through a lateral bore 41 of the distal end of the central pole 4. (The lateral bore 41 can be designed as a through bore or a bore). Besides, the same central pole 4 can secure the pliable handle 10 by means of riveting.

Figure 8:
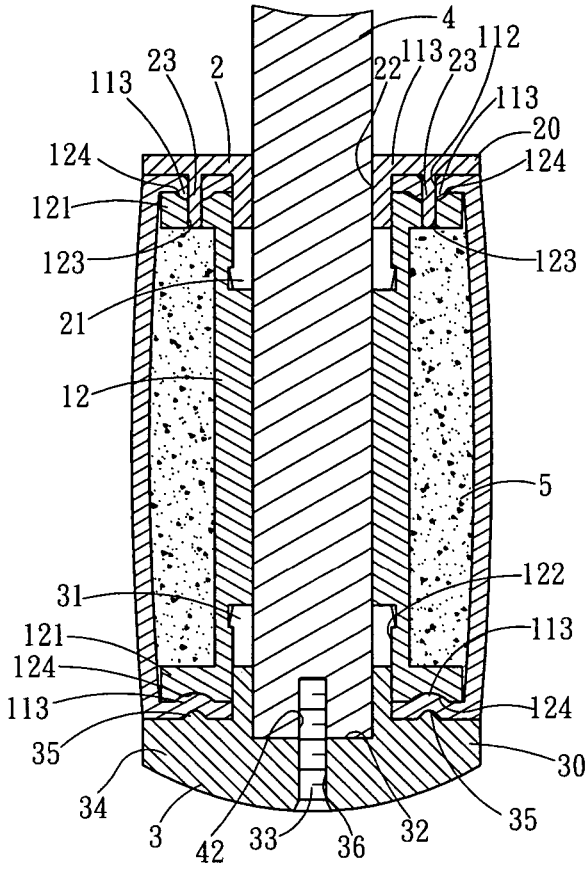
FIG. 8 is a cross section view of another embodiment of the pliable handle.

Refer to FIG. 8, is illustrated a longitudinal bore 36 at a center of the distal end of the distal board 30, the longitudinal bore 36 is designed for a screw 33 passed through then fits into a straight bore 42 of the distal end of the central pole 4. It is understood as another embodiment of screwing as the straight bore 42 instead of said lateral bore 41.

Figure 4:
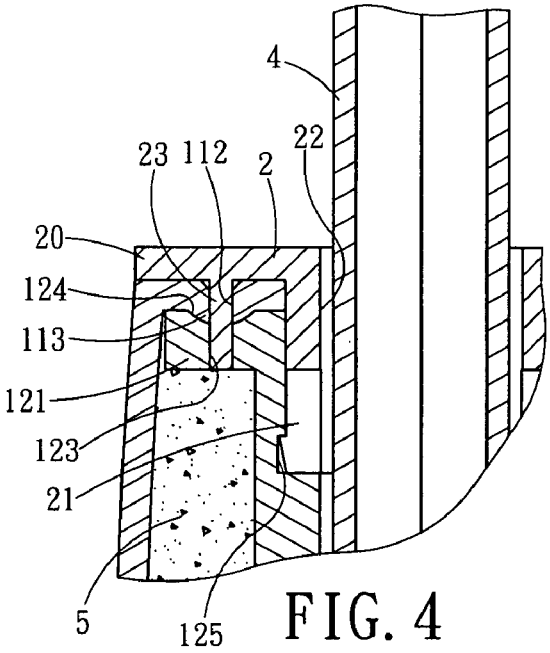
FIG. 4 is a sectional plan view in partial cutaway of the combined open-end core, plastic cover and proximal cap to seal the injection through bore.

FIGS. 3 and 4 are illustrated the plastic cover 11 has stopper flanges 110 at both ends, inner sides of the stopper flanges 110 has axially shift protrude positioned dots 113 to fit into positioned bores 124 formed through the annular lips 121 at both ends of the open-end core 12 respectively. Thus increased the friction between the stopper flanges 110 and annular lips 121, as the plastic cover 11 has endured the pressure exerted by an exterior force, the stopper flange 110 and annular lip 121 can be combined to form as a whole one to avoid from shift movements. One injection through bore 112 is formed through a center of the shift protrude positioned dot 113 on the proximal stopper flange 110 of the plastic cover 11. Whereas the corresponding distal stopper flange 110 of the plastic cover 11 has a positioned dot 113 without a bore formed through. Therefore, as the plastic cover 11 secures the open-end core 12, and the shift protrude positioned dot 113 is adapted to the positioned bore 124, thus is aligned one injection through bore 112 with the other injection through bore 123 on the proximal end speedily.

On one hand, as the manufacturer first made use of a needle-like injector of a syringe-like barrel (not shown) passed through one injection through bore 112 of the plastic cover 11 and the other injection through bore 123 of the open-end core 12, then forces the gel 5 into the gel-containing portion, finally presses the proximal cap 2 onto the proximal end of the handle 1. The proximal board 20 of the proximal cap 2 covers the proximal flange 110 of the plastic cover 11. On the other hand, after gel injection, a projected stopper spindle 23 beneath the proximal board 20 is passed through one injection through bore 112 then fits into the other injection through bore 123 of the open end bore 12 to seal the injection through bores 112, 123. Thus keeps the gel from leaking out.

Furthermore, a groove 125 is formed along an outer surface of the distal hollow trough 122 of the open-end core 12, a diameter of the groove 125 is larger than a diameter of the distal hollow trough 122. Said inverse barb-like projections 21, 31 can fit into the hollow troughs 122 at the ends of the open-end core 12. The projections 21,31 have slits along circumferences to separate each of the projections 21,31 as pieces of projected plates. Thus the projections 21, 31 fit into the open-end core 12 easily but being hard to draw out of the open-end core 12. As the proximal cap 2 fits in the proximal end of the handle 1, the stopper spindle 23 beneath the proximal board 20 can be applied to seal the aforesaid injection through bores 112,123. As the distal cap 3 fits in the distal end of the handle 1, a protrude dot 35 formed on the distal board 30 is corresponding to and aligned with the distal end of the shift protrude positioned dot 113 on the distal flange 110 of the plastic cover 11. The central bore 32 of the distal board 30 is in an axial line aligned with the central through bore 120 of the open-end core 12 and the through bore 22 of the proximal cap 2. Therefore, the central pole 4 first is passed through the proximal cap 2 then secures the open-end core 12 to the central bore 32 of the distal cap 3 by means of screwing or riveting.

Figure 5:
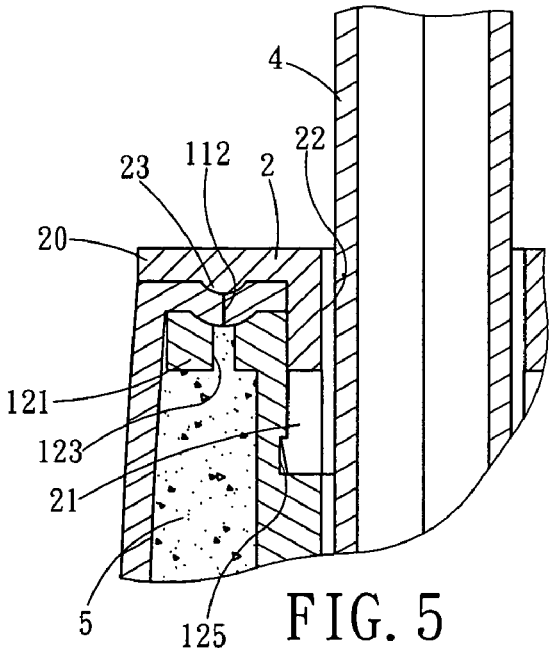
FIG. 5 is another embodiment of the FIG. 4.
Figure 6:
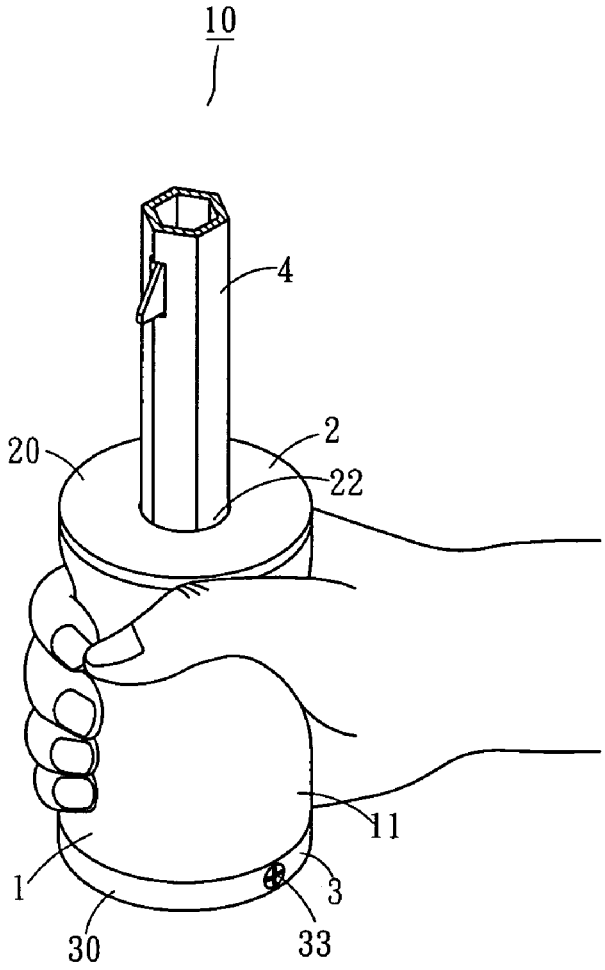
FIG. 6 is a diagram view illustrating the pliable handle in use.

Refer to FIG. 5, is illustrated the manufacturer applies a needle-like injector of a syringe-like barrel (not shown) to inject the gel 5 through the injection through bores 112,123 then fits into the gel-containing portion. After gel injection, the proximal cap 2 is used to press the proximal end of the handle 1, the proximal board 20 of the proximal cap 2 is provided as a cover for the proximal flange 110 of the plastic cover 11. And the projected stopper spindle 23 beneath the proximal board 20 presses close the injection through bores 112, 123. But the projected spindle 23 is still not used to seal the bores 112, 123. Until the injected needle-like injector is pulled out, one injection through bore 112 of the plastic cover 11 is restored to the original configuration sealing the other injection through bore 123 of the open-end core 12 by elasticity. After that, due to the sealed injection through bore 112 being pressed and sealed by the projected spindle 23, the gel 5 is prevented from from leaking out.

Figure 7:
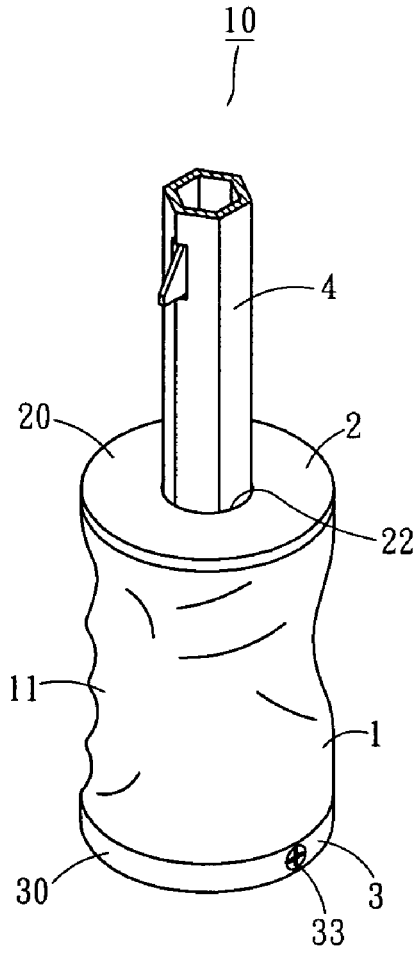
FIG. 7 is a diagram view illustrating the pliable handle endured pressure.

Refer to FIG. 7, as the user exerts pressure on the pliable handle 10 by hand, the plastic cover 11 and the gel 5 is in a transformation shape. The plastic cover 11 keeps an ergonomic touch conformed to the fingers shape. Refer to FIG. 8, as the users release the comfort hand grab, the pliable handle still keeps the temporary transformation shape of the fingers contour. Until the gel 5 is flowed slowly to restore to the original configuration of the pliable handle 10.

Figure 9:
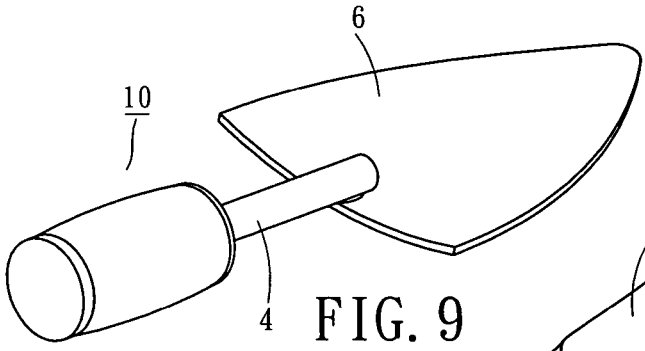
FIG. 9 is a diagram view of the pliable handle secures to a spade.
Figure 10:
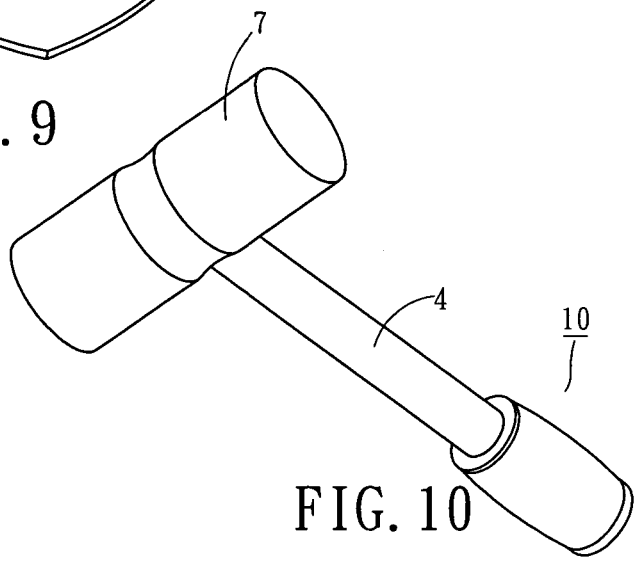
FIG. 10 is a diagram view of the pliable handle secures to a hammer.

Said central pole 4 is not only suitable for an umbrella. Refer to FIGS. 9 and 10, are illustrated said central pole 4 is applied to a spade 6, or a hammer 7 as an outstretched pole. Another embodiments of the pliable handle can be applied to walking stick, screwdriver, club.

What is claimed is:

1. A pliable handle comprises:

a plastic cover (11) comprising a sleeve with a proximal stopper flange at one end and a distal stopper flange (110) at the other end, an elongated open-end core (12) having a proximal annular lip at one end and a distal annular lips (121) at the other end, said plastic cover (11) being disposed about said open-end core (12) to define a gel-containing portion between an inner wall of the plastic cover (11) and an outer surface of the open-end core (12);

at least a first gel injection through bore (112) formed through the proximal stopper flange (110) of the plastic cover (11), at least a second gel injection through bore (123) formed through the proximal annular lip (121) of the open-end core (12); said first injection through bore (112) being aligned with the second gel through bore (123);

a gel (5) injected through said first gel injection through bore (112) and said second gel injection through bore (123), said gel surrounding the open-end core (12);

a tough hardening proximal cap (2), said proximal cap (2) having a circular proximal board (20) and a central bore (22) at a center thereof, said proximal board having an inverse barb-like cylindrical projection (21) extending downward from said proximal board, a diameter of the projection (21) is smaller than a diameter of the proximal cap (2), a peripheral of the proximal board (20) having at least one stopper spindle (23) extending downward from said proximal board and being parallel and spaced from said projection (21), said projection (21) fits into a proximal trough (122) of the open-end core (12), said stopper spindle (23) being inserted in said first and second gel injection through bores to seal the gel in said gel-containing portion;

a tough hardening distal cap (3), said distal cap (3) having a circular distal board (30) and a bore (32) at a center thereof, said distal board having an inverse barb-like cylindrical projection (31) extending upward from said distal board, a diameter of the projection (31) is smaller than a diameter of the distal board (30), the projection (31) fits into a distal through (122) of the core (12), and a central pole (4) is inserted through the proximal end cap (2) and the open-end core (12) and secured to the distal cap (3).

2. A pliable handle of claim 1, wherein said central pole is secured to the bore (32) of the distal cap by a screw.

3. A pliable handle of claim 1, wherein said central pole is secured to the bore (32) of the distal cap by a rivet.

4. A pliable handle of claim 1, wherein said first gel injection through bore (112) is resealable by elasticity of said cover, and said stopper spindle (23) is adapted to press and seal said bore after injection of said gel.

5. A pliable handle of claim 1, wherein each inner side of the flanges of the plastic cover has axially protruding positioning dots (113), said dots are adapted to engage positioning bores (124) formed through each of the annular lips of the open-end core.

* * * * *